US006409157B1

(12) United States Patent
Lundin et al.

(10) Patent No.: US 6,409,157 B1
(45) Date of Patent: Jun. 25, 2002

(54) AIR TREATMENT UNIT

(75) Inventors: Bertil Lundin, Sollentuna (SE); Geoffrey Bowers, Montville (AU); Patricia Tyson Thomas, Fort Myers, FL (US)

(73) Assignee: Munters AB, Sollentuna (SE)

( * ) Notice: Subject to any disclaimer, the term of this patent is extended or adjusted under 35 U.S.C. 154(b) by 0 days.

(21) Appl. No.: 09/582,165

(22) PCT Filed: Dec. 21, 1998

(86) PCT No.: PCT/SE98/02411

§ 371 (c)(1),
(2), (4) Date: Sep. 7, 2000

(87) PCT Pub. No.: WO99/32845

PCT Pub. Date: Jul. 1, 1999

(30) Foreign Application Priority Data

Dec. 22, 1997 (SE) ..... 9704832
Jul. 8, 1998 (SE) ..... 9802463

(51) Int. Cl.[7] ..... B01F 3/04

(52) U.S. Cl. ..... 261/94; 261/112.2; 96/294; 96/299; 96/300

(58) Field of Search ..... 261/94, 112.2; 96/294, 299, 300, 327, 328, 356

(56) References Cited

U.S. PATENT DOCUMENTS

| | | | | | |
|---|---|---|---|---|---|
| 2,932,361 | A | * | 4/1960 | Beringer | 96/300 |
| 3,262,682 | A | * | 7/1966 | Bredberg | 261/112.2 |
| 3,395,900 | A | * | 8/1968 | Meek | 261/112.2 |
| 3,500,615 | A | | 3/1970 | Meek | |
| 3,513,907 | A | | 5/1970 | Hughes | |
| 3,792,841 | A | * | 2/1974 | Munters | 261/112.2 |
| 3,795,091 | A | | 3/1974 | Rennie | |
| 3,918,688 | A | * | 11/1975 | Huber et al. | 261/112.2 |
| 3,947,532 | A | * | 3/1976 | Skold et al. | 261/112.2 |
| 3,983,190 | A | | 9/1976 | Norback | 261/112.2 |
| 4,031,180 | A | * | 6/1977 | Bohanon | 261/112.2 |
| 4,427,607 | A | * | 1/1984 | Korsell | 261/112.2 |
| 5,055,239 | A | | 10/1991 | Thomas | 261/112.2 |
| 5,653,115 | A | | 8/1997 | Brickley et al. | |

FOREIGN PATENT DOCUMENTS

| | | | | |
|---|---|---|---|---|
| DE | 2831639 | * | 3/1980 | 261/112.2 |
| EP | A1401682 | | 12/1990 | |
| EP | A1531795 | | 3/1993 | |
| GB | A-2092288 | | 7/1981 | |
| JP | 59-60137 | * | 4/1984 | 261/112.2 |
| JP | 3-284319 | * | 12/1991 | 261/112.2 |
| SE | B432059 | | 3/1984 | |

* cited by examiner

*Primary Examiner*—C. Scott Bushey
(74) *Attorney, Agent, or Firm*—Birch, Stewart, Kolasch & Birch, LLP

(57) ABSTRACT

An air treatment unit for treatment of an air stream, including a pad having a multitude of narrow air-flow channels, the walls of which are formed by corrugated sheets of a stiff material, the sheets being positioned and fixed generally in parallel planes next to each other in such a way that, as seen from an inlet side of the pad to an outlet side thereof, the channels formed by the corrugations of any two sheets located next to each other extend in two different directions the vertical plane of the respective sheet. At least in a central region of the pad, all sheets are positioned obliquely sideways, whereby all channels extend obliquely sideways relative to inlet and outlet surfaces of the pad.

22 Claims, 2 Drawing Sheets

AIR TREATMENT UNIT

BACKGROUND OF THE INVENTION

1. Field of the Invention

This application is the national phase under 35 U.S.C. § 371 of PCT International Application No. PCT/SE98/02411 which has an International filing date of Dec. 21, 1998, which designated the United States of America.

The present invention relates to an air treatment unit for treatment of an air stream flowing in a substantially horizontal direction and being blown through the unit from an inlet side to an outlet side, comprising at least one pad having an inlet surface, an outlet surface and a multitude of narrow air-flow channels extending from said inlet surface to said outlet surface, the walls of said channels being formed by corrugated sheets of a stiff material, said sheets being positioned and fixed generally in mutually parallel, substantially vertical planes next to each other in such a way that the channels formed by the corrugations of any two adjacent sheets extend in two different directions from said inlet surface to said outlet surface.

2. Description of Background Art

Such air treatment units are being frequently used today, in particular in order to humidify and cool the air stream while the pad is being drained with water. See, e.g., the instruction manual "CELdek/GLASdek Contact material for evaporative cooling/humidification" issued by Munters Component AB 1993. Then, the water is evaporated and the air will thereby exchange sensible heat for latent heat. Preferably, the corrugated sheets forming the pad are impregnated with a wetting agent, so that the total surface area of the channel walls are constantly wet so as to secure an effective evaporation. The stiff material of the corrugated sheets may be a cellulose material, a glass fibre material, a synthetic fibre material or a plastic material or even an aluminium alloy provided with a hygroscopic surface layer. The corrugated sheets are positioned with the corrugations oriented in alternate directions, preferably being repeated for every second sheet, so that the channels formed by the corrugations are directed in different directions in adjacent or neighbouring sheets. At the time of manufacture, the sheets are glued together at the points where the corrugations cross each other, so as to form a rigid and stable unit. Normally, at the edge portions, the pad formed by the corrugated sheets can be firmly held in a frame, e.g. of stainless steel, aluminium or some other rigid, incombustible and non-corrosive material.

The pad can also be used as a droplet separator to be placed downstream a cooling pad or somewhere else in an air treatment unit or system where the air stream has a high velocity and contains water droplets. Since the channels in the pad stand at an angle in relation to the inlet flow direction of the airstream, the water droplets will hit the walls of the channels and be absorbed by the wet walls thereof.

The cooling or separator pads described above, in particular those manufactured and marketed by Munters, under the registered trademark CELdek and GLASdek, have proven to operate efficiently and reliably with long life in cooling and ventilation systems in buildings for public use, offices, industry, agriculture and livestock buildings. The last-mentioned application has become very important, in particular for raising animals and birds, especially chickens in large numbers. The pads are also being used in gas turbine inlets.

SUMMARY AND OBJECTS OF THE INVENTION

Thus, this kind of air treatment units with pads of corrugated sheets have become commercially very important, and there is a constant demand for further improvement. Accordingly, the main object of the present invention is to provide an air treatment unit with higher efficiency, increased strength and generally improved performance. A further, specific object is to provide an improved pad which enables a higher air stream velocity and a higher cooling and humidification efficiency.

These objects are achieved for an air treatment unit wherein, at least in a central, major region of the pad, said mutually parallel planes of said corrugated sheets are oriented obliquely relative to a substantially horizontal direction being normal to said inlet surface, whereby said air-flow channels extend obliquely not only in said two directions in said mutually parallel planes, but also obliquely sideways in a third direction as seen in said substantially horizontal, normal direction, as a consequence of said oblique orientation of said mutually parallel planes. In this way, for a given thickness of a pad, the air stream will be forced to travel a longer distance in the channel from the inlet surface to the outlet surface of the pad, whereby the evaporative process will be enhanced. Of course, there will also be an increased pressure drop caused by the extra deflection of the air stream. However, it has turned out that the net effect is a significant improvement of the cooling and humidifying capacity of the pad (for a given volume or thickness) and a greatly improved capacity of droplet separation, respectively. Thus, it is possible to maintain the total mass or volume flow of the air stream while significantly increasing the cooling and humidifying efficiency. The increased efficiency is specially pronounced for relatively thin pads and relatively high air velocities. Alternatively, it is possible to use a thinner pad to achieve the same cooling and humidifying effect.

Also, the new pad will have an increased strength, in particular bending resistance, which is important when handling the pad during manufacture and transport. The increased strength is primarily a consequence of the fact that there will be more points of glue contact between the corrugations of the sheets in a given volume.

Another advantage with the new structure of the air treatment pad is its light blocking capacity. Because of the oblique positioning of the air-flow channels, any light impinging onto one side of the pad will not pass through to the other side, unless the light rays are reflected at the channel walls. By proper treatment of these walls, the light reflection can be practically eliminated. So, there will be hardly any light passing through the pad. In some applications, such as in chicken farms, this feature may be very important, especially when using artificial light which is not synchronous with the daylight. In such installations, the cooling and humidifying pads are normally mounted as wall elements in the building (fans being mounted in an opposite wall).

It is also possible to use the new pad as a filter for small particles or liquid drops following the air stream, e.g. in connection with ventilation of spray booths or the like.

The light or particle blocking capacity can be significantly increased by including at least two sections of the pad located one after the other in the air stream, the channels in neighbouring sections extending sideways in opposite directions.

In order to secure a good operation also at the side edge portions of the pad, the latter may be provided with channels extending in planes aligned with said normal direction and communicating with associated obliquely sideways oriented channels disposed in a region located between these edge portions. Such edge portions are preferably wedge-like.

The pad or pads may be arranged in various ways in relation to the air stream, either with the normal direction being substantially aligned with an axial main direction of the air treatment unit or with the normal direction standing at an oblique angle to such an axial main direction. Alternatively, the air treatment unit may be provided with two or more air inlet regions each having a specific inlet flow direction. In the latter case, it is advantageous to arrange two or more pads next to each other in a zig-zag configuration in each inlet region.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
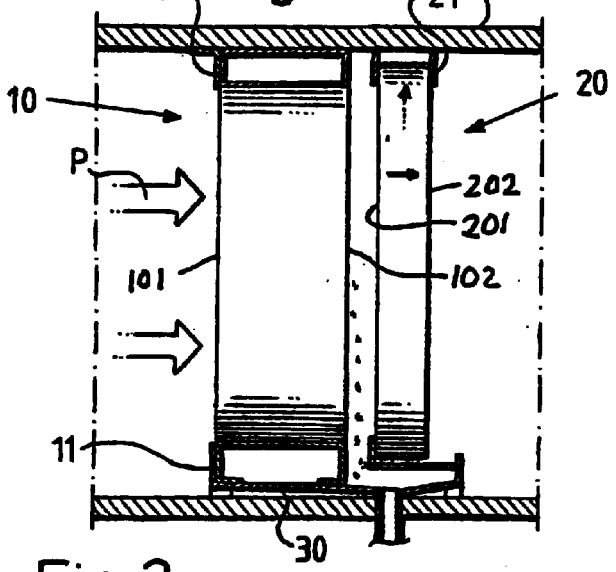
FIG. 1 shows in a sectional view a first embodiment of an air treatment unit according to the invention, including an air duct provided with a cooling pad and a droplet separator.

The air treatment unit shown in FIG. 1 includes a longitudinally extending air duct 1 in which there is mounted an air treatment unit including a cooling and humidifying pad 10 and a droplet separator 20, the latter being located downstream the cooling and humidifying pad 10, as seen in an axial, substantially horizontal, main direction indicated by the arrows P in FIG. 1. A fan, not shown, is mounted so as to maintain a steady air stream flowing through the air treatment unit.

As is known per se, the cooling and humidifying pad 10 is held by a metal frame 11, e.g. of stainless steel or aluminium. In a similar manner, the droplet separator pad 20 is held by a frame 21. Although not shown in FIG. 1, there is a water supply system with nozzles for pouring water onto the top surface of the cooling and humidifying pad 10. Thus, as is known per se, see e.g. the Swedish patent application No.9700968-2, the pad 10 is continuously or at least frequently, drained with water so as to keep the same constantly wet at all portions thereof. The water supplied to the top surface of the pad will pour down through the channels all the way to the bottom so as to keep the channel walls wet at all times. Some excess water will be collected in a drain vessel 30 arranged below the pads 10 and 20. The drain vessel 30 will collect water also from the droplet separator 20. The latter has no supply of water at the top but will only collect water drops contained in the air-stream flowing out from the pad 10 at relatively high velocity.

In the air treatment unit shown in FIG. 1, the air stream flowing into the unit in the direction of the arrows P will pass through the cooling and humidifying pad 10, where the air is cooled and humidified by evaporation of water in the air-flow channels. Upon flowing out from the pad 10, the air will contain some water drops which, however, are absorbed in the droplet separator 20.

Figure 2:
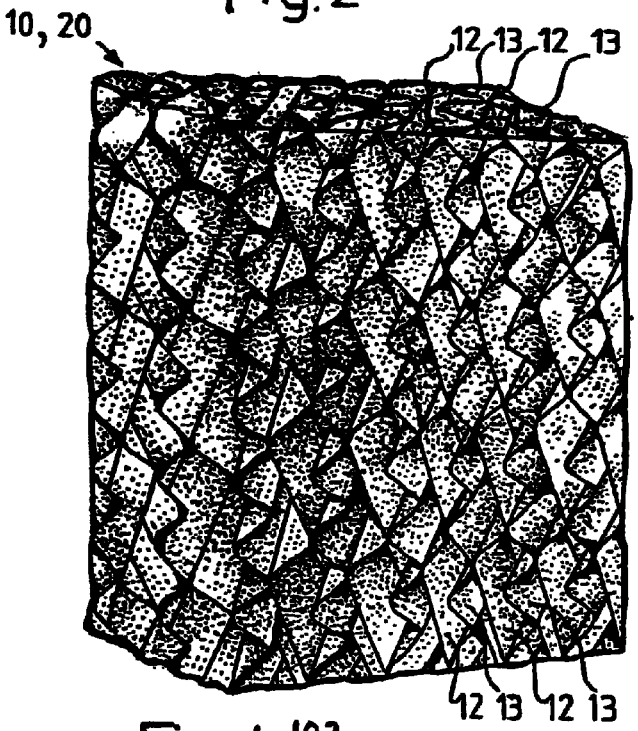
FIG. 2 shows, in a perspective view, the cooling pad included in the air treatment unit of FIG. 1.
Figure 3:
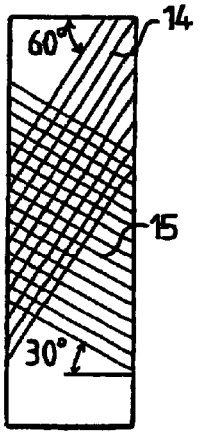
FIG. 3 shows schematically a cross section of the pad shown in FIG. 2 (the section being taken in parallel to the corrugated sheets of the pad)
Figure 4:
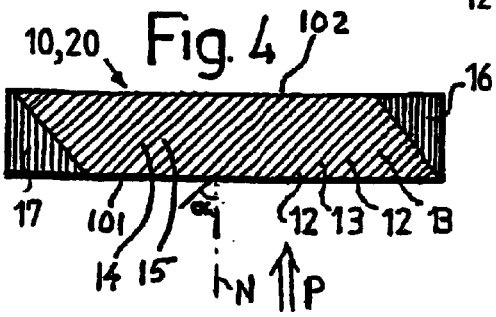
FIG. 4 shows, likewise schematically, a top view of the pad provided with wedge-like side edge portions.

The basic structure of the pads 10 and 20 is illustrated in FIGS. 2, 3 and 4.

The pad 10 is made of alternately positioned corrugated sheets of cellulose material being chemically impregnated with special compounds to prevent rot and to make the material stiff and non-combustible. The corrugations are oriented in such a way that the channels formed thereby are oriented in different directions in any two adjacent or neighbouring sheets, such as the sheets 12 and 13 in FIG. 2. In particular, compare FIG. 3, the channels of every second sheet may be inclined upwards at a steep angle e.g. 60°, whereas the channels of the sheets located therebetween are inclined downwards at an angle of about 30°, as seen in vertical planes being parallel to the respective sheet 12, 13. At the points, where the corrugations cross each other, the neighbouring sheets 12, 13 are securely held together by glue applied when manufacturing the pad.

According to the present invention, all the sheets of the pads 110 and 20, at least in the central portion thereof as illustrated in FIG. 4, are oriented obliquely sideways, as seen in a substantially horizontal direction N being normal to the inlet and outlet surfaces 101, 201 and 102, 202, respectively, of the pads 10, 20. In this embodiment, the channels 14 and 15 also extend obliquely sideways relative to the axial main direction P.

Such a structure of the pad brings about several advantages, as discussed in general terms above.

For a cooling and humidifying pad, such as the pad 10 (see FIG. 4), the fixed angle a of sideways obliqueness is preferably 30°–60°, typically 40°–50°, relative to the direction N being normal to the inlet and outlet surfaces 101, 102.

For a droplet separator, such as the separator pad 20, on the other hand, the corresponding angle $\alpha$ should be smaller, in particular 5°–30°, most preferably 10°–20°.

As will be apparent to those skilled in the art, the particular angle should be chosen in view of the particular dimensions of the pad. A typical cooling and humidification pad can if have a length of 50–200 cm, a width of 60 cm and a thickness of 2.5–30 cm. Correspondingly, a typical droplet separator pad can have a length of 50–200 cm, a width of 60 cm and a thickness of 2.5–30.

In order to ensure that the whole pad is operationally effective, it is advantageous to arrange wedge-like side edge portions having channels extending perpendicularly to the inlet and outlet surfaces 101, 102, as illustrated in FIG. 4. In this way, the air flowing sideways towards the side edge of the pad, to the right in FIG. 4, will be deflected in the straight channels of the side edge portion 16. Correspondingly, to the left in FIG. 4, the channels of the opposite side edge portion 17 will communicate with the channels 14, 15 of the central portion of the pad. In this way, the whole pad can have the shape of a parallelepipedic block fitting easily into a rectangular frame, such as the frames 11, 21 indicated in FIG. 1.

Figure 5:
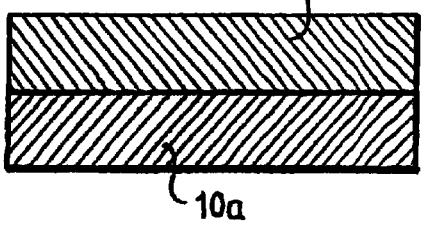
FIG. 5 shows, likewise schematically, a top view of a pad with two sections having channels extending obliquely sideways in opposite directions.

Another possible modification is to arrange two or more pad sections one after the other in the axial main direction, as illustrated schematically in FIG. 5, where the channels of the first section 10*a* are positioned obliquely sideways in a first direction, whereas the channels of the other section 10*b* are positioned obliquely sideways in the opposite direction.

Figure 6:
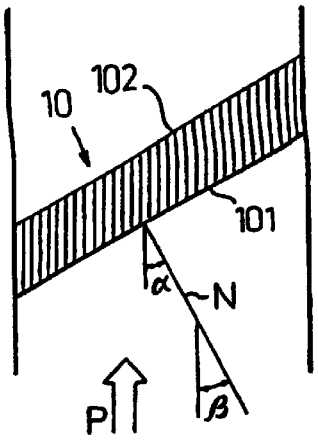
FIG. 6 shows schematically a top view of a second embodiment of an air treatment unit according to the invention.
Figure 7:
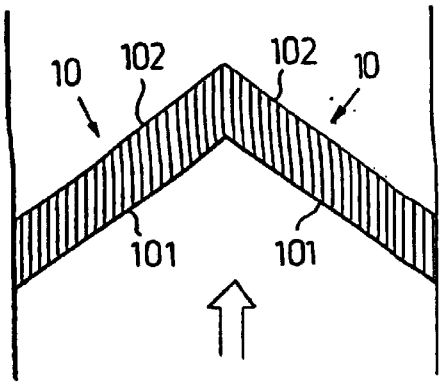
FIGS. 7 and 8 show modified versions of the second embodiment of FIG. 6.
Figure 8:
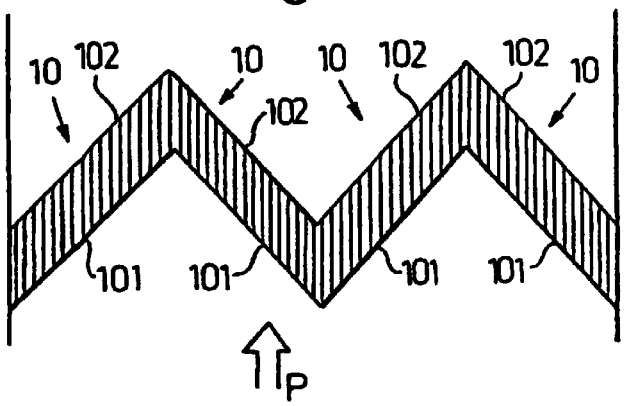

A second embodiment of the invention, as illustrated in FIGS. 6–8, provides for an oblique orientation of each pad in an air duct where an air stream is flowing in a main direction P. In FIG. 6, there is a single pad 10 which is disposed obliquely, so that the air stream P impinges at an angle β relative to the direction N being normal to the inlet surface 101 of the pad. Preferably, although not necessarily, the angle β is substantially the same as the angle a between the sheets 12, 13 constituting the pad 10 and said normal direction N. In this way, the channels in the pad 10 will be substantially aligned to the axial main direction P of the air stream in the air duct. Such an arrangement has proven to be especially efficient and to enable very high air velocities, such as up to about 4 m/s or even more. With such air velocities, the efficiency and capacity of the unit will be further enhanced. This can be explained by the fact that, although the pressure drop will increase somewhat because of the longer path for the air flowing through each obliquely oriented channel, the increased effective surface area in the air flow channels in a given volume of the pad and the increased air velocity will give an overall improvement.

The angle β between the main direction P of the air stream in the air duct and the direction N being normal to the inlet surface 101 of the pad 10 should be 20° to 60°, preferably 30° to 60°, and most preferably 40° to 50°, in particular about 45°. As mentioned above, the angle β does not necessarily have to coincide with the angle α.

The thickness of the pad is normally in the range of 2.5–30 cm.

It is often advantageous, especially in case the air duct is relatively wide, to dispose two or more pads 10 next to each other so as to form a V-like configuration, as shown in FIG. 7, or a zig-zag configuration, as shown in FIG. 8.

Figure 9:
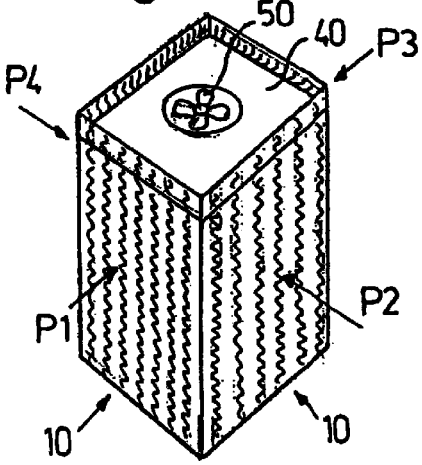
FIG. 9 shows, in a schematical, perspective view, a third embodiment of an air treatment unit according to the invention.
Figure 10:
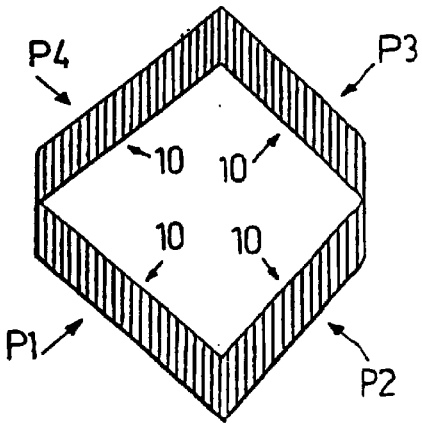
FIG. 10 shows a cross-section of the unit of FIG. 9.

According to a third embodiment of the invention, as illustrated in FIGS. 9 and 10, the inlet area of the air treatment unit may be divided into two or more inlet regions each having a specific inlet direction. The illustrated embodiment comprises a box-like unit having four side walls each being constituted by a pad 10. At one end wall 40 of the unit, the upper one in FIG. 9, there is an exhaust fan 50 which draws air into the unit through the side wall pads 10 into the interior of the unit and out through the upper end wall. The lower end wall, which is not shown in the drawing, may be formed by a pad or a closed wall.

As shown in FIG. 10 the air will flow into the unit in different inlet flow directions P1, P2, P3 and P4, each being perpendicular to the respective side wall pad 10, at the different inlet regions (adjacent to the four sides of the box-like unit).

In general according to the third embodiment of the invention, it is of course possible to arrange, in each inlet region having a substantial horizontal main inlet flow direction, two or more pads next to each other in a V-like or zig-zag configuration, i.e., similar to the configurations shown in FIGS. 6–8.

Moreover, the structure of the pad in the air treatment unit of the invention may be modified in various ways within the scope of the appended claims. For instance, the angle indicated in FIG. 3, i.e. the angle of inclination in the vertical planes of the corrugated sheets, may be varied at will as long as the corrugations cross each other so as to form a stable and rigid structure. Also, the stiff material constituting the pad can be modified in many ways, e.g. as indicated above.

A further possible modification is to use the pad merely as a filter for catching solid particles or liquid drops contained in an air stream. Instead of draining the pad with water, it is conceivable to apply an adhesive layer onto each corrugated sheet. Then, the particles or drops will be caught permanently in the pad structure serving as a replaceable filter.

What is claimed is:

1. An air treatment unit for treatment of an air stream flowing in a substantially horizontal direction and being blown through the unit from an inlet side to an outlet side, said air stream interacting with water pouring downwardly through said unit comprising at least one pad having a substantially vertical inlet surface, an outlet surface and a plurality of narrow air-flow channels extending from said inlet surface to said outlet surface, the walls of said channels being formed by corrugated sheets of a stiff material, said sheets being positioned and fixed generally in mutually parallel, substantially vertical planes next to each other in such a way that the channels formed by the corrugations of any two adjacent sheets extend in two different directions from said inlet surface to said outlet surface, wherein:

at least in a central major region of the pad, said mutually parallel, substantially vertical planes of said corrugated sheets are oriented obliquely relative to a substantially horizontal direction being normal to said inlet surface, whereby said air-flow channels extend obliquely, not only in said two directions in said mutually parallel planes, but also obliquely sideways in a third direction, as seen in said substantially horizontal, normal direction, as a consequence of said oblique orientation of said mutually parallel planes.

2. The air treatment unit as defined in claim 1, wherein said mutually parallel planes are oriented obliquely sideways at a fixed angle (α) of 5°–60° relative to said normal direction.

3. The air treatment unit as defined in claim 2, said pad serving to humidify and cool the air being blown therethrough, wherein said fixed angle (α) is 30°–60°.

4. The air treatment unit as defined in claim 2, said pad serving to separate water drops from said air stream, wherein said fixed angle (α) is 5°–30°.

5. The air treatment unit as defined in claim 4, wherein said fixed angle (α) is 10°–20°.

6. The air treatment unit as defined in claim 1, said pad including at least two sections located one after the other in said air stream, wherein said mutually parallel planes are oriented obliquely sideways at different angles in said at least two sections.

7. The air treatment unit as defined in claim 6, wherein said angles are opposite to each other so that the channels in neighbouring sections are oriented sideways in opposite directions.

8. The air treatment unit as defined in claim 1, wherein said pad has side edge portions with channels, which extend in planes aligned with said normal direction and which communicate with associated obliquely sideways oriented channels disposed in a central region of said pad located between said side edge portions.

9. The air treatment unit as defined in claim 8, wherein the total pad, including said side edge portions, is configured as a parallelepipedic block.

10. The air treatment unit as defined in claim 9, wherein said side edge portions are wedge-shaped.

11. The air treatment unit as defined in claim 1, wherein said air stream is blown along an axial main direction of the unit substantially in parallel to said normal direction.

12. The air treatment unit as defined in claim 1, wherein said air stream is blown along an axial main direction of the unit substantially at an oblique angle (β) to said direction being normal to the inlet surface of said at least one pad.

13. The air treatment unit as defined in claim 1, wherein an air stream is blown along an axial main direction of the unit substantially at an oblique angle (β) of 20°–60° to said main direction.

14. The air treatment unit as defined in claim 13, wherein said oblique angle (β) is 30°–60°.

15. The air treatment unit as defined in claim 13, wherein said oblique angle (β) is 40°–50°.

16. The air treatment unit as defined in claim 13, wherein said oblique angle (β) is substantially the angle (α) between said mutually parallel planes of said corrugated sheets and said direction being normal to said inlet surface, so that said mutually parallel planes, in which the air-flow channels of said at least one pad are located, are substantially parallel to the axial main direction of said air stream.

17. The air treatment unit as defined in claim 13, wherein said pad is obliquely mounted between said opposite walls.

18. The air treatment unit as defined in claim 13, wherein two pads are mounted next to each other in a V-shaped configuration between said opposite walls.

19. The air treatment unit as defined in claim 13, wherein a series of pads are mounted next to each other in a zig-zag configuration between said opposite walls.

20. The air treatment unit as defined in claim 1, wherein two said air stream, on said inlet side of the unit, is divided into at least two air inlet regions, each having a specific inlet flow direction.

21. The air treatment unit as defined in claim 1, wherein at least four pads are mounted so as to form a box-shaped unit, said at least four pads forming side walls of said box-shaped unit and serving as inlet regions for said air stream, the latter being exhausted by means of a fan disposed at an end wall of said box-shaped unit.

22. The air treatment unit as defined in claim 2, said pad serving to humidify and cool the air being blown therethrough, wherein said fixed angle (α) is 40°–50°.

* * * * *